US005216984A

United States Patent [19]

Shimano et al.

[11] Patent Number: 5,216,984

[45] Date of Patent: Jun. 8, 1993

[54] V-TYPE INTERNAL COMBUSTION ENGINE WITH IMPROVED WATER PUMP DRIVING ARRANGEMENT

[75] Inventors: Satoshi Shimano; Isaya Matsuo; Toshiki Ohara; Kaoru Haga, all of Kanagawa, Japan

[73] Assignee: Nissan Motor Co., Ltd., Yokohama, Japan

[21] Appl. No.: 918,012

[22] Filed: Jul. 24, 1992

[30] Foreign Application Priority Data

Jul. 26, 1991 [JP] Japan ..... 3-187175
Jul. 26, 1991 [JP] Japan ..... 3-187176
Jul. 31, 1991 [JP] Japan ..... 3-191515

[51] Int. Cl.[5] ..... F01P 5/10

[52] U.S. Cl. ..... 123/41.44; 123/41.47; 123/55 VS; 123/90.31; 123/195 R; 123/198 C

[58] Field of Search ..... 123/41.1, 41.44, 41.47, 123/55 VF, 55 VS, 55 VE, 90.27, 90.31, 198 C, 195 C, 195 R

[56] References Cited

FOREIGN PATENT DOCUMENTS 61-78228 5/1986 Japan .
62-95123 6/1987 Japan .
63-34308 3/1988 Japan .

*Primary Examiner*—Noah P. Kamen
*Attorney, Agent, or Firm*—Foley & Lardner

[57] ABSTRACT

In a V-type internal combustion engine, a timing chain is placed around and engaged with a pair of camshaft sprockets and a crankshaft sprocket. A water pump sprocket is disposed between one of the camshaft sprockets and the crankshaft sprocket and outside of an area bounded by the timing chain and engaged with the timing chain. A thermostat housing is provided integrally to a front end portion of one of the cylinder heads which is bounded by the water pump, the timing chain and a camshaft which is adjacent to an outer side of a bank and driven by one of the above mentioned camshafts. A cylinder block is provided with an engine mounting boss portion at a front end central portion thereof surrounded by the timing chain.

16 Claims, 8 Drawing Sheets

V-TYPE INTERNAL COMBUSTION ENGINE WITH IMPROVED WATER PUMP DRIVING ARRANGEMENT

BACKGROUND OF THE INVENTION

1. Field of the Invention

The present invention relates in general to a V-type internal combustion and more particularly to a water pump driving arrangement for such an engine. Furthermore, the present invention relates to the layout or arrangement of a thermostat housing and an engine mounting boss portion for a V-type internal combustion engine.

2. Description of the Prior Art

A water pump for an internal combustion engine includes a pump housing which is arranged so as to cover a coolant inlet at the front end of a cylinder block. The water pump is driven by a crankshaft by way of a belt drive mechanism using a so-called V-belt. More specifically, a pulley is installed on a water pump shaft which is in turn supported on the pump housing, and the V-belt is placed around the pump shaft pulley and a crankshaft pulley.

In the case of an overhead valve engine, a camshaft or camshafts are installed on a cylinder head and driven by the crankshaft by way of timing belts or chains which are housed in a front cover at the front end of the engine. The pump housing is located more forward of the front cover and thus protrudes considerably from the front end of the cylinder block.

The pump shaft is installed on the pump housing by way of bearings.

A problem of the prior art water pump driving arrangement is that the timing chains and the V-belt are arranged in sequence in a lengthwise direction of the engine. Due to this, the crankshaft pulley and the pump shaft pulley protrude considerably forward of the engine, thus causing a problem that the length of the engine is considerably large.

Another problem is that the durability of the bearings for support of the pump shaft is poor since the distance between the water pump pulley and its adjacent bearing is large. Further, the durability of the bearings is liable to become further worse since the V-belt requires a large angle of contact with the water pump shaft pulley, causing the water pump shaft pulley to be pulled strongly in one direction.

SUMMARY OF THE INVENTION

In accordance with the present invention, there is provided a V-type internal combustion engine which comprises a cylinder block having left and right banks, two cylinder heads installed on the respective banks of the cylinder block, two camshafts installed on the cylinder heads, respectively, two camshaft sprockets located at front ends of the cylinder heads and installed on the respective camshafts for rotation therewith, a crankshaft installed on the cylinder block, a crankshaft sprocket located at a front end of the cylinder block and installed on the crankshaft for rotation therewith, a timing chain placed around and engaged with the camshaft sprockets and the crankshaft sprocket for drivingly connecting the crankshaft to the camshafts, and a water pump installed on the front end of the cylinder block and having a water pump sprocket, the water pump sprocket being disposed between one of the camshaft sprockets and the crankshaft sprocket and outside of an area bounded by the timing chain and engaged with the timing chain.

It is accordingly an object of the present invention to provide a novel and improved V-type internal combustion engine which is small-sized, particularly in the lengthwise size.

It is a further object of the present invention to provide a novel and improved V-type internal combustion engine of the above described character which can reduce the amount of projection of the water pump in the forward direction of the engine.

It is a further object of the present invention to provide a novel and improved V-type internal combustion engine of the above described character which can improve the loading on a bearing or bearings for support of a pump shaft of the water pump for thereby improving the durability of same.

It is a further object of the present invention to provide a novel and improved V-type internal combustion engine of the above described character which makes it possible to provide a front end portion of a cylinder head with an integral thermostat housing without making the thermostat housing protrude laterally of the cylinder head.

It is a further object of the present invention to provide a novel and improved V-type internal combustion engine of the above described character which can effect an excellent maintainability of the thermostat valve.

It is a further object of the present invention to provide a novel and improved V-type internal combustion engine of the above described character which makes it possible to provide the cylinder block and the cylinder head with an internal passage for providing communication between the thermostat housing and the water pump, which is superior in seal to the case in which an external pipe is used between the thermostat housing and the water pump.

It is a further object of the present invention to provide a novel and improved V-type internal combustion engine of the above described character which makes it possible to support the front end portion of the engine at a point adjacent to the center of gravity of the engine for thereby effecting an excellent engine vibration damping action.

It is a further object of the present invention to provide a novel and improved V-type internal combustion engine of the above described character which makes it possible to attain a most efficient three-point support of the engine.

It is a further object of the present invention to provide a novel and improved V-type internal combustion engine of the above described character which enables the engine mounting boss portion and the water pump to be arranged adjacently to each other at the front end portion of the engine for thereby preventing the front end portion of the engine from becoming large-sized.

It is a further object of the present invention to provide a novel and improved V-type internal combustion engine of the above described character which can dispense with an idle sprocket.

DESCRIPTION OF THE PREFERRED EMBODIMENTS

Figure 1:
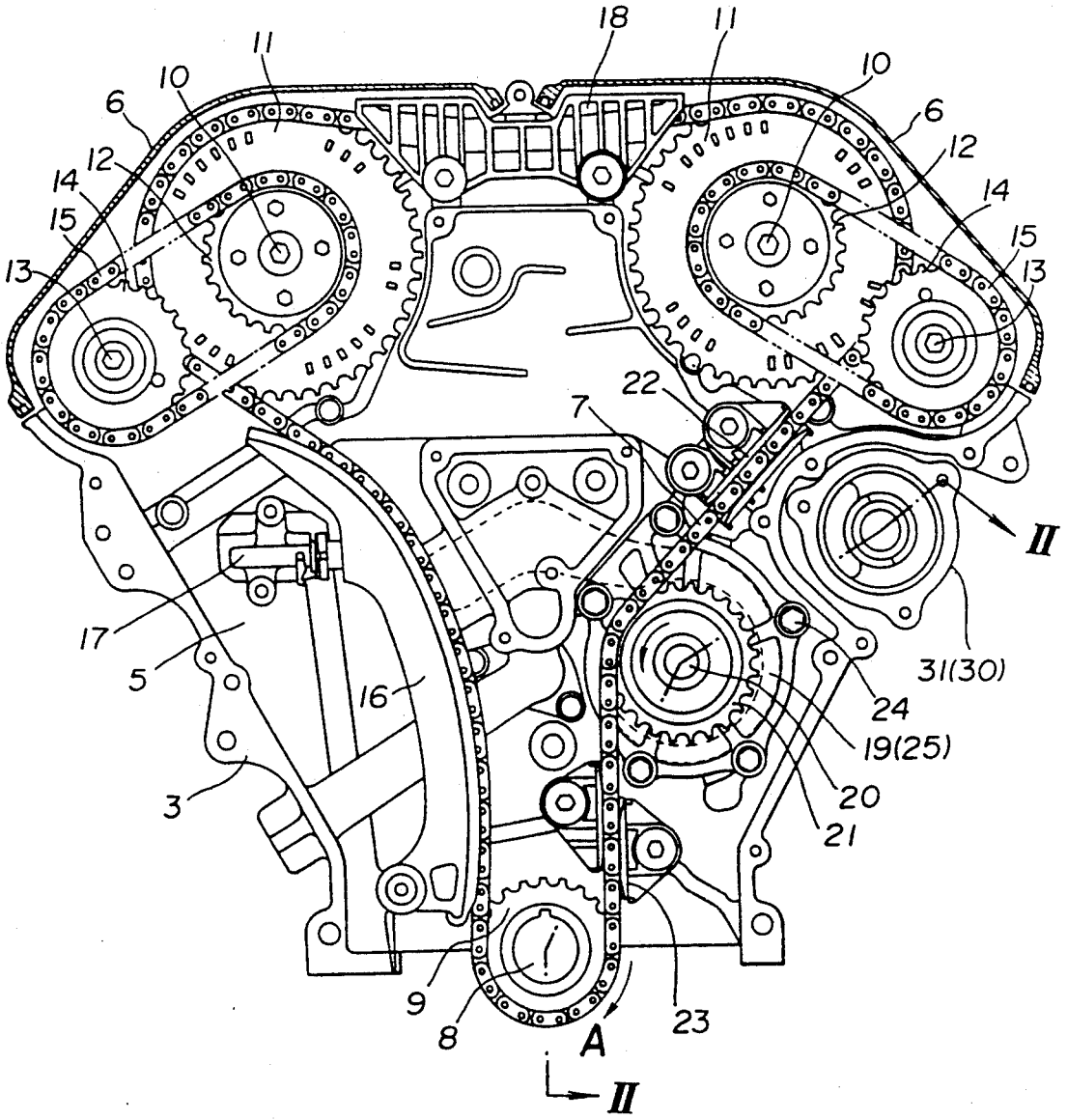
FIG. 1 is an elevational view of a V-type internal combustion engine incorporating a water pump driving arrangement according to an embodiment of the present invention, with some parts being omitted with a view to illustrating a chain chamber construction.

Referring to FIGS. 1 through 9, a cylinder block 1 is fixedly connected at the upper ends of its left and right banks with cylinder heads 2, respectively. A chain case rear member 3 in the form of a plate and made of, for example, a die cast aluminium alloy is disposed so as to cover the front ends of the cylinder block 1 and the cylinder heads 2. Installed on the front end of the chain case rear member 3 is a chain case front member 4 in the form of a cover, so as to define therebetween a chain chamber 5. The V-type engine is shown in FIG. 1 in the state where the chain case front member 4 is removed, with a view to illustrating the inside of the chain chamber 5. The upper portion of the chain chamber 5 is covered by the front end portions of cylinder head covers 6.

A crankshaft 8 is installed on a lower portion of the cylinder block 1. A crankshaft sprocket 9 is installed on the crankshaft 8 for rotation therewith. First intake valve operating camshaft sprockets 11 are installed on intake valve operating camshafts 10 for rotation therewith. The intake valve operating camshafts 10 are in turn installed on the respective cylinder heads 2 at the left and right banks of the cylinder block 1. A single timing chain 7 is placed around and engaged with the first intake valve operating camshaft sprockets 11 and the crankshaft sprocket 9 in such a manner as to form a nearly triangular shape. Further installed on the respective intake valve operating camshafts 10 for rotation therewith are second intake valve operating camshaft sprockets 12 which are smaller in diameter than the first intake valve operating camshaft sprockets 11. The second intake valve operating camshaft sprockets 12 are located a little forward of the corresponding first intake valve operating camshaft sprockets 11. Each pair of first and second intake valve operating camshaft sprockets 11 and 12 are thus installed on each common camshaft 10 in such a way so as to be located adjacently to each other, i.e., arranged in sequence in an axial direction of the respective intake valve operating camshafts 10 and adjacently to each other.

Exhaust valve operating camshaft sprockets 14 are installed on exhaust valve operating camshafts 13 for rotation therewith, respectively. The exhaust valve operating camshaft sprockets 14 and the second intake valve operating camshaft sprockets 12 are arranged so as to lie on a common plane extending to cross the camshafts 10, 13 and the crankshaft 8 at right angles. Sub-timing chains 15 are wound around and engaged with the exhaust valve operating camshaft sprockets 14 and the second intake valve operating camshaft sprockets 12, respectively. The intake valve operating camshafts 10 installed on the cylinder heads 2 at the left and right banks of the cylinder block 1 are driven by the crankshaft 8 which rotates in the direction indicated by the arrow "A" in FIG. 1. In this connection, the first intake valve operating camshaft sprockets 11 and the crankshaft sprocket 9 are arranged so as to lie on a common plane extending to cross the camshafts 10 and the crankshaft 8 at right angles. The exhaust valve operating camshafts 13 are in turn driven by the intake valve operating camshafts 10 by way of the sub-timing chains 15 and rotatable in timed relation thereto. The timing chain 7, the sub-timing chain 15 and the sprockets 11, 12 and 14 are disposed at the front ends of the cylinder block 1 and the cylinder heads 2 and housed in the chain chamber 5.

A chain guide 16 pivotally supported at the lower end thereof and provided with a hydraulic chain tensioner 17 is disposed between one of the first intake valve operating camshaft sprockets 11 located on the slack side, i.e., the left-hand side of the above described timing chain 7 in FIG. 1, and the crankshaft sprocket 9. By this, a force is applied to the timing chain 7 for suitably tensioning the same. Further, a chain guide 18 is disposed between the first intake valve operating camshaft sprockets 11 for slightly urging the timing chain 7 inward.

A water pump 19 is disposed between the other of the first intake valve operating camshaft sprockets 11 located on the stretched side, i.e., the right-hand side of the timing chain 7 in FIG. 1, and the crankshaft sprocket 9. The water pump 19 includes a drive shaft 20 and a water pump sprocket 21 installed thereon. The water pump sprocket 21 is located outside of the timing chain 7, i.e., outside of the triangular area bounded by the timing chain 7, and engaged with the timing chain 7. The water pump sprocket 21 is located nearly at the middle between the first intake valve operating camshaft sprocket 11 and the crankshaft sprocket 9 and arranged so as to push the timing chain 7 inward. Chain guides 22 and 23 are disposed above and below the water pump sprocket 21, respectively.

Figure 2:
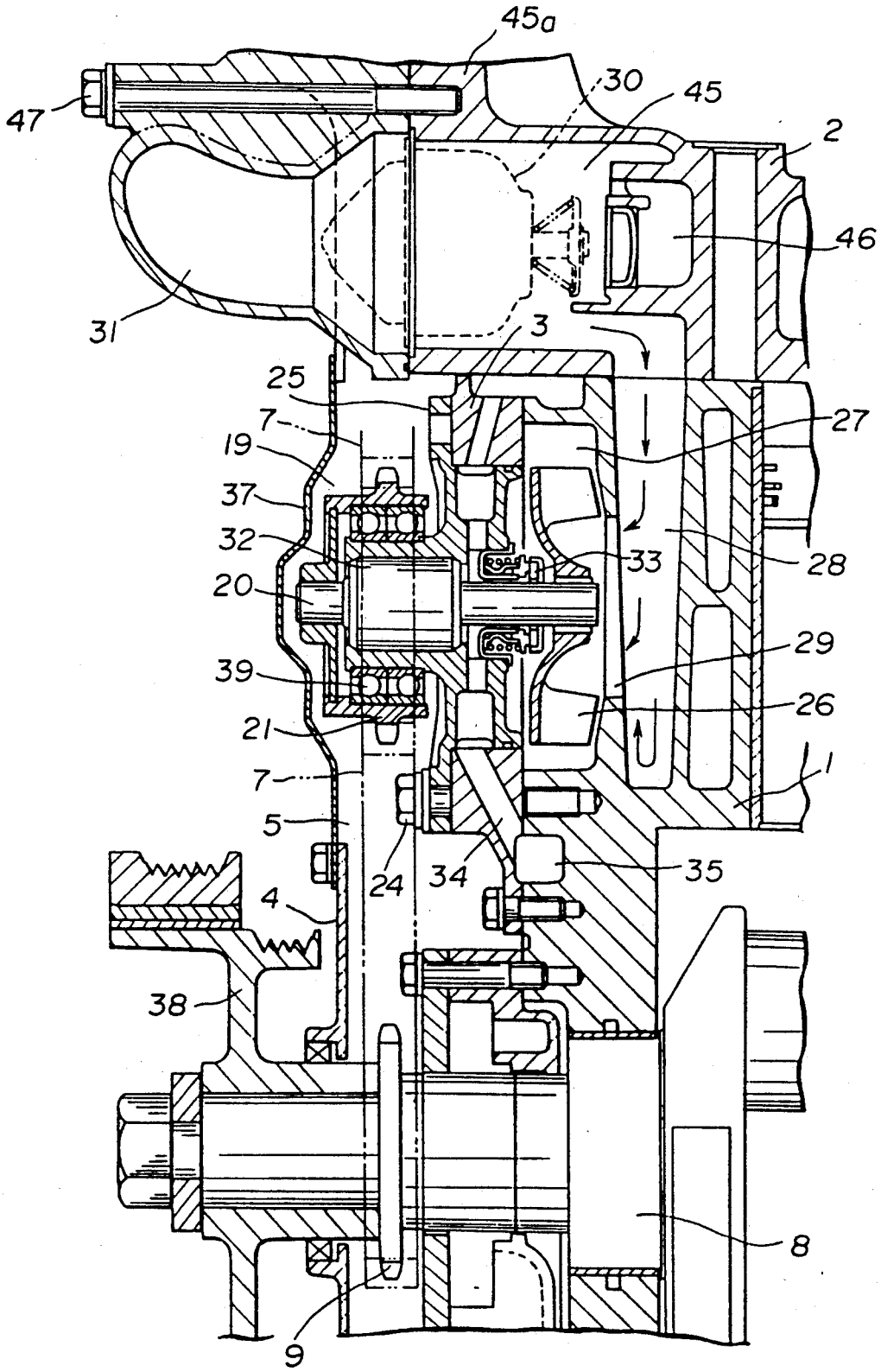
FIG. 2 is an enlarged sectional view taken along the line II—II of FIG. 1.
Figure 3:
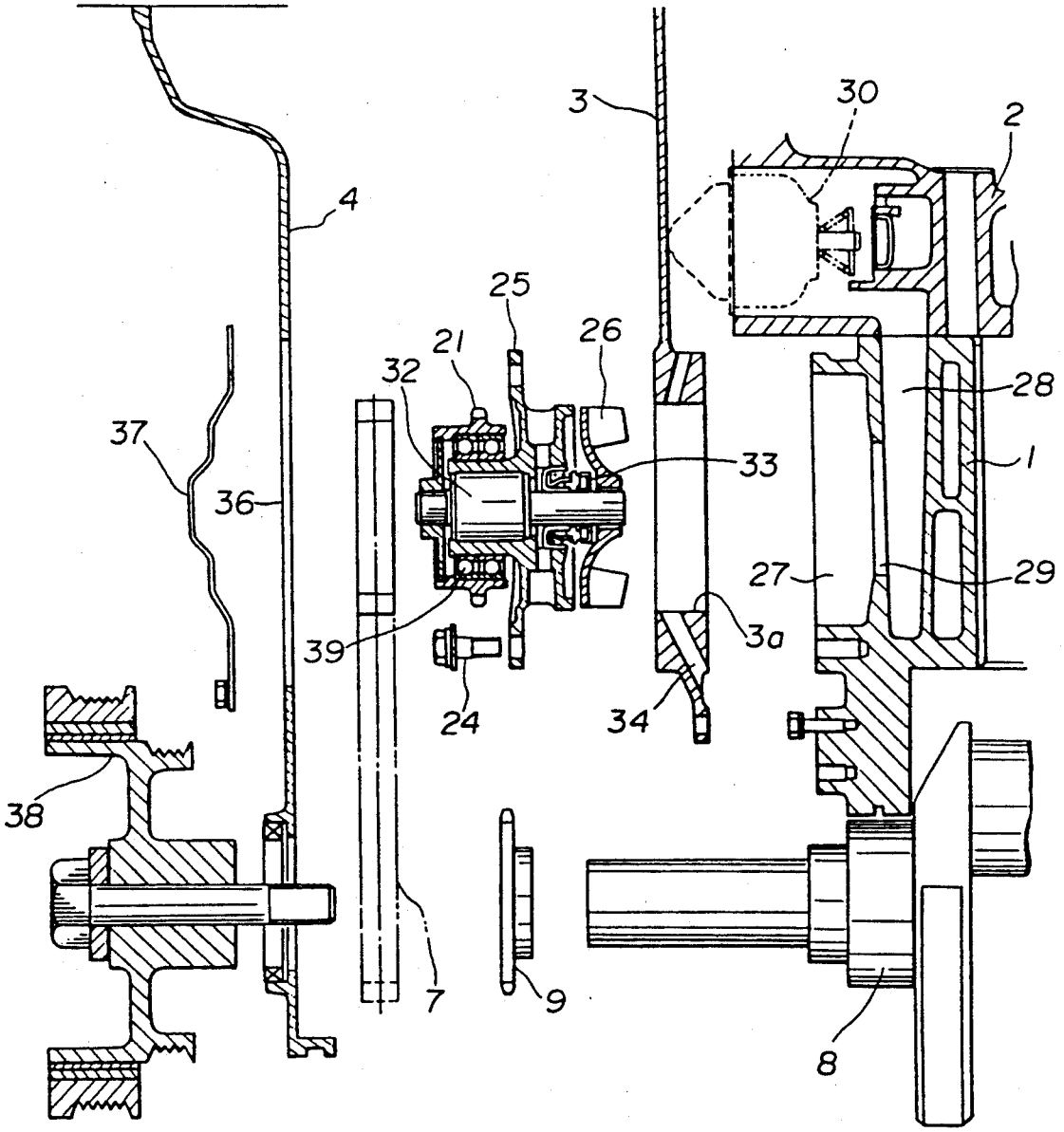
FIG. 3 is an exploded view of the water pump driving arrangement and its associated parts of FIG. 1.
Figure 5:
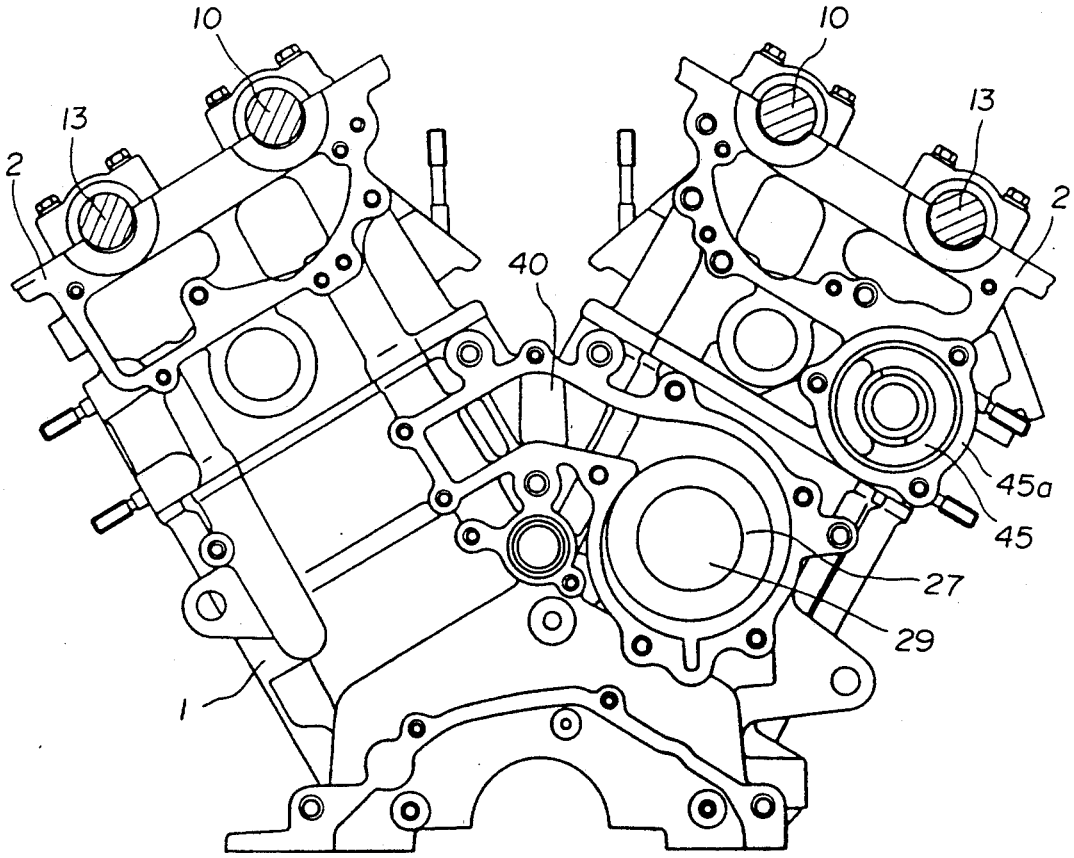
FIG. 5 is an elevational view of a cylinder block and cylinder heads of the engine of FIG. 1 for illustrating the front end structure thereof.
Figure 6:
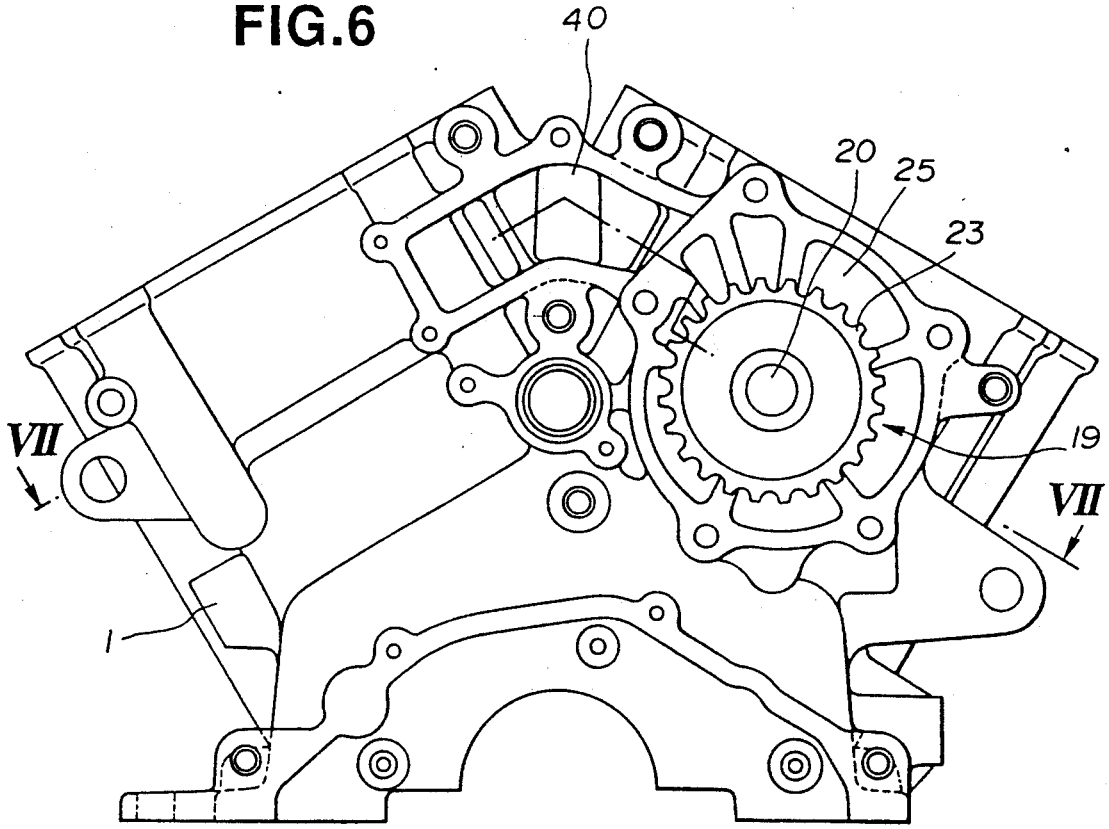
FIG. 6 is an elevational view of the cylinder block of FIG. 5 together with a water pump.
Figure 7:
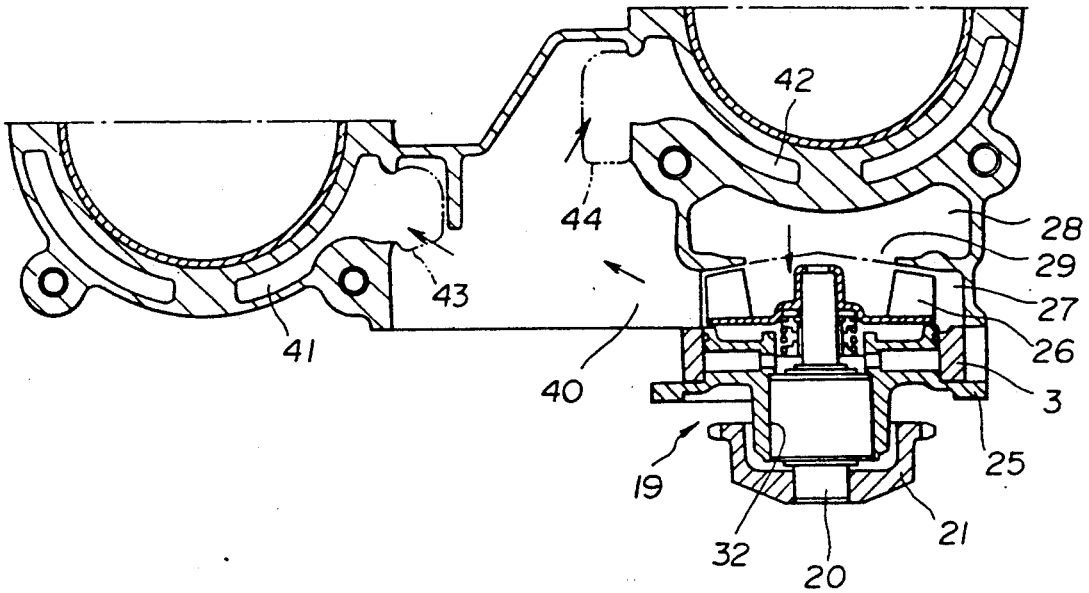
FIG. 7 is a sectional view taken along the line VII—VII of FIG. 6.

The water pump 19, as shown in FIGS. 2 and 3, mainly consists of a pump housing 25 secured with bolts 24 (though only one is shown) to an opening portion 3*a* of the chain case rear member 3 and an impeller 26 secured to an end of the drive shaft 20. The impeller 26 is located in an involute chamber 27 formed in the front end wall of the cylinder block 1. The involute chamber 27, as shown in FIGS. 5 to 7, has a coolant inlet portion 40 at the front end of the cylinder block 1 and at a location midway between the banks. The involute chamber 27 is communicated through the coolant inlet portion 40 with water jackets 41 and 42 formed in the left and right banks of the cylinder head 1. Coolant inlets 43 and 44, as shown by two-dot chain lines in FIG. 7, are formed in the cylinder block 1 in such a way as to open to the front end thereof. Cooling water or coolant in the water jackets 41 and 42 in the cylinder block 1 is conducted to the cylinder heads 2 through the coolant inlets 43 and 44. To this end, a coolant passage 28 is formed in the cylinder block 1 at the rear of the involute chamber 27, i.e., between the involute chamber 27 and the water jacket 42 in such a manner as to open to the upper end of the cylinder block 1. The involute chamber 27 and the coolant passage 28 are communicated with each other through an opening 29 formed in the cylinder block 1. The opening 29 is located in opposition to the central portion of the impeller 26. The coolant inlet passage 28 is connected to an inlet tube 31 by way of a thermostat valve 30 installed in the cylinder head 2. The drive shaft 20 is rotatably supported on the pump housing 25 by means of a bearing 32 in the form of a journal bearing. In order to prevent intrusion of coolant into the bearing 32, a mechanical seal 33 is interposed between the impeller 26 and the pump housing 25. In order that a small amount of coolant having passed the above described mechanical seal 33 is discharged or drained to the outside, the chain case rear member 3 is formed with a drain passage 34 communicating a space 35 between the cylinder block 1 and the chain case rear member 3. The space 35 is communicated with the outside or open air. A ball bearing 39 is interposed between the water pump sprocket 21 and the pump housing 25, i.e., the water pump sprocket 21 is installed on the pump housing 25 by way of the bearing 39.

In FIG. 3, the chain case front member 4 is formed with an access hole 36 for access to the water pump 19, which hole 36 is eventually closed by the water pump cover 37. A crankshaft pulley 38 is installed on the crankshaft 8 for driving engine accessories such as an alternator, etc.

The thermostat valve 30 is arranged horizontally and installed in a thermostat housing 45. The thermostat housing 45 is arranged in a recessed side wall portion of the chain case rear member 3 bounded by the water pump 19, one of exhaust valve operating camshaft sprockets 14 and the timing chain 7.

The coolant passage 28, as shown in FIG. 2, is communicated with the inside of the thermostat housing 45. The thermostat housing 45, as seen from FIGS. 2 and 5, is formed integrally with a front end portion of one of the cylinder heads 2, i.e., the right-hand one as best seen from FIG. 5. More specifically, the thermostat housing 45 is in the form of a cup opening forward of the cylinder head 2 and located under the exhaust valve operating camshaft 13. The thermostat housing 45 has a peripheral flange 45*a*. A bypass passage 46 has an end portion opening to the inner bottom portion of the thermostat housing 45 and is communicated with a coolant outlet (not shown). The inlet tube 31 is secured with bolts 47 to the flange 45*a* of the thermostat housing 45 while holding therebetween the thermostat valve 30 disposed horizontally within the thermostat housing 45. The thermostat valve 30 is a so-called bottom bypass type and adapted to control communiation between the coolant passage 28 and the bypass passage 46. More specifically, coolant is discharged from the water pump 19 and forcedly supplied into the water jackets 41 and 42 of the cylinder block 1 and water jackets (not shown) of the cylinder heads 2 through the front ends thereof and flows rearward of the engine. The coolant is then discharged from the coolant outlet at the rear end of the engine and supplied through an outside pipe (not shown) to a radiator (not shown). From the radiator, the coolant is conducted by way of the inlet tube 31 and the thermostat valve 30 to the coolant passage 28 and flows into the water pump 19 again. When the temperature of coolant is low to cause the thermostat valve 30 to be held closed, coolant flowing out of a coolant outlet (not shown) at the rear end portion of the engine is supplied to the bypass passage 46 by way of an outside bypass pipe (not shown) and flows back to the water pump 19 without passing through the radiator.

Figure 4:
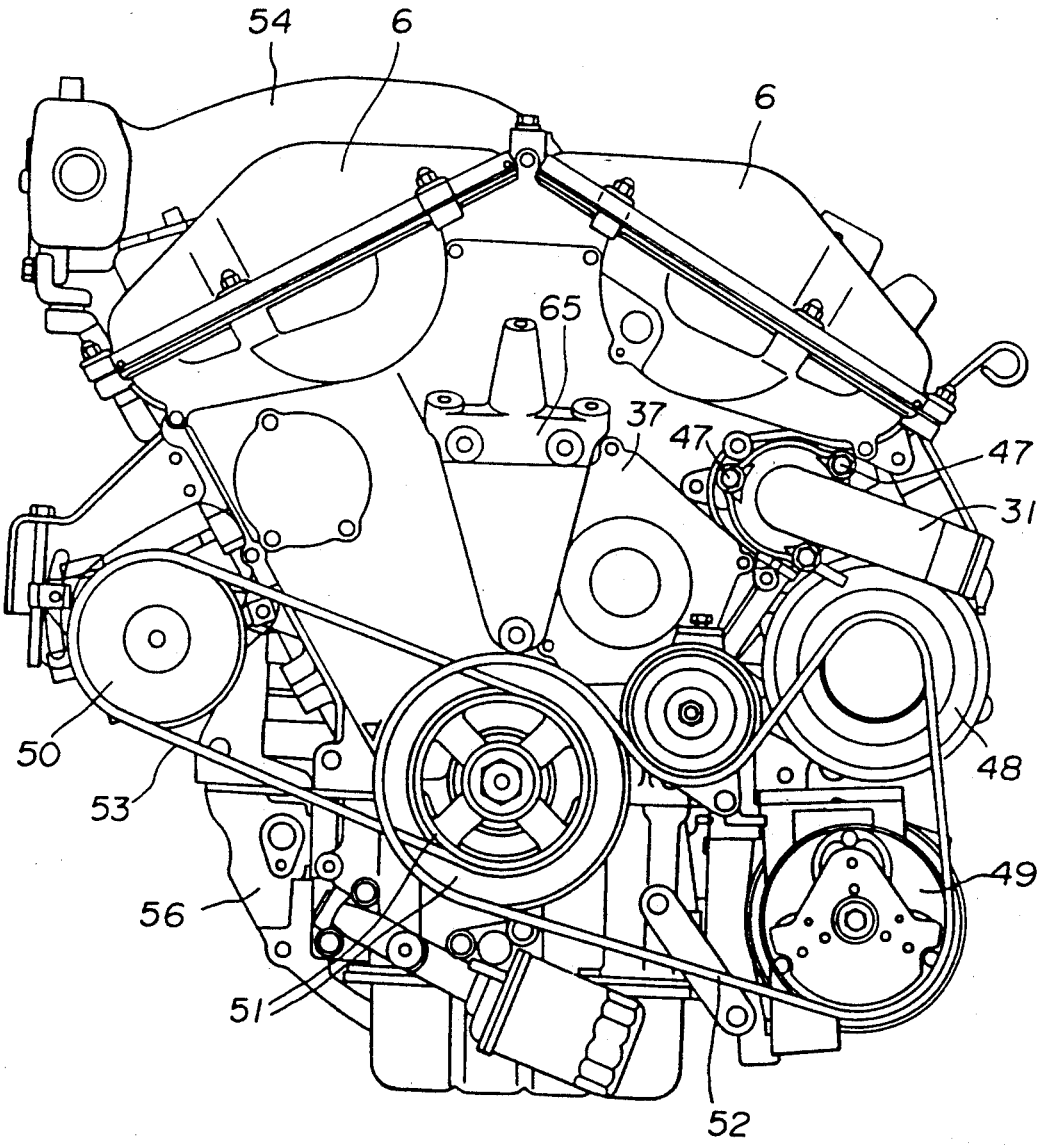
FIG. 4 is an elevational view of the V-type internal combustion engine of FIG. 1, equipped with various engine accessories.

FIG. 4 shows a V-type internal combustion engine equipped with various engine accessories. As seen from FIG. 4, the inlet tube 31 secured to the thermostat housing 45 with bolts 47 is bent so as to be directed sideway of the engine. In FIG. 4, 48 is an alternator, 49 is a compressor for an air conditioner, and 50 is an oil pump for a power steering device. Those are driven by crankshaft pulleys 51 by way of V-belts 52 and 53, respectively. Further, 54 is an intake manifold, 55 is an engine mounting bracket and 56 is an oil pan.

Figure 8:
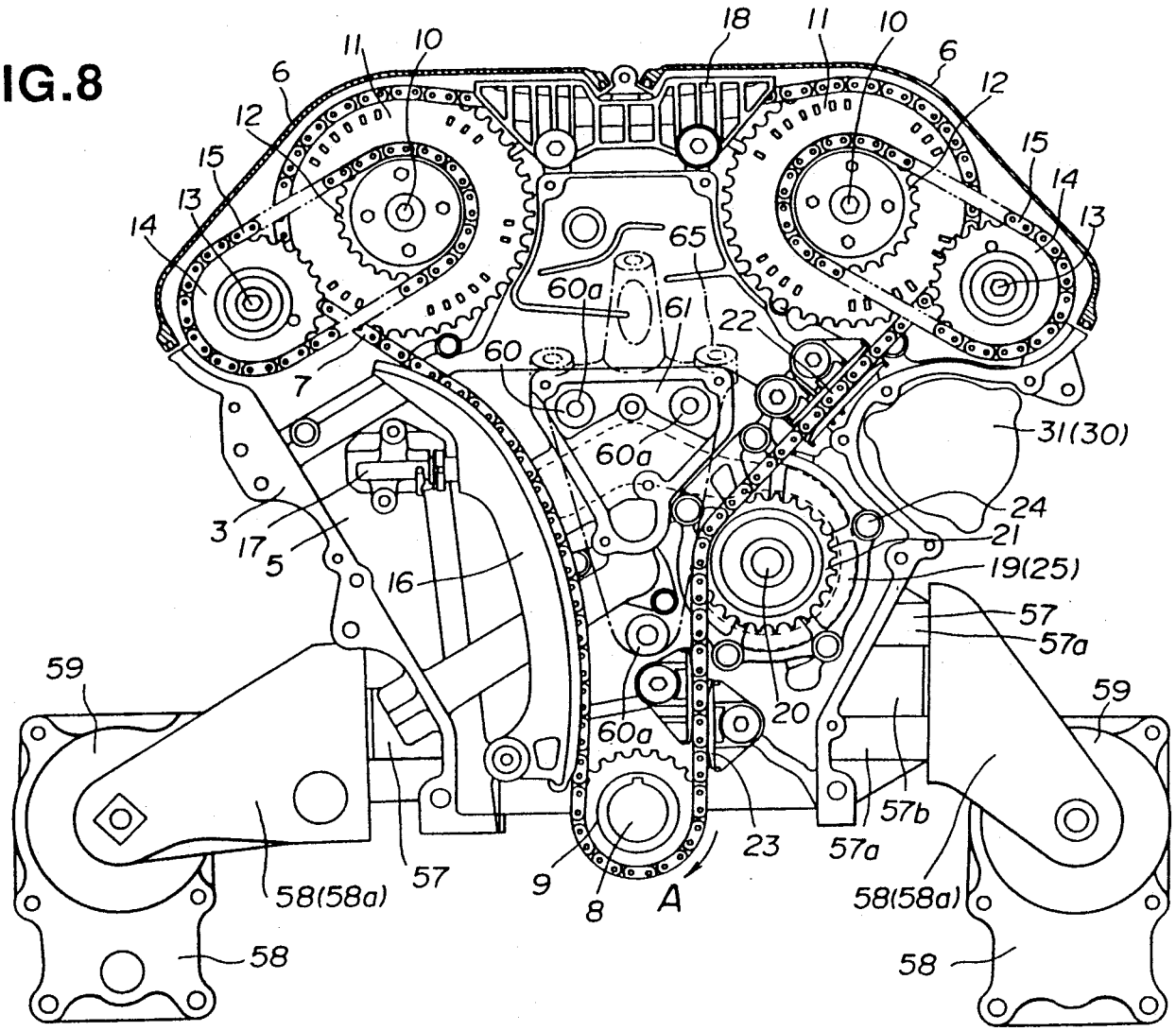
FIG. 8 is a view similar to FIG. 1 showing an arrangement of engine mounting boss portions together with engine mounting brackets.
Figure 9:
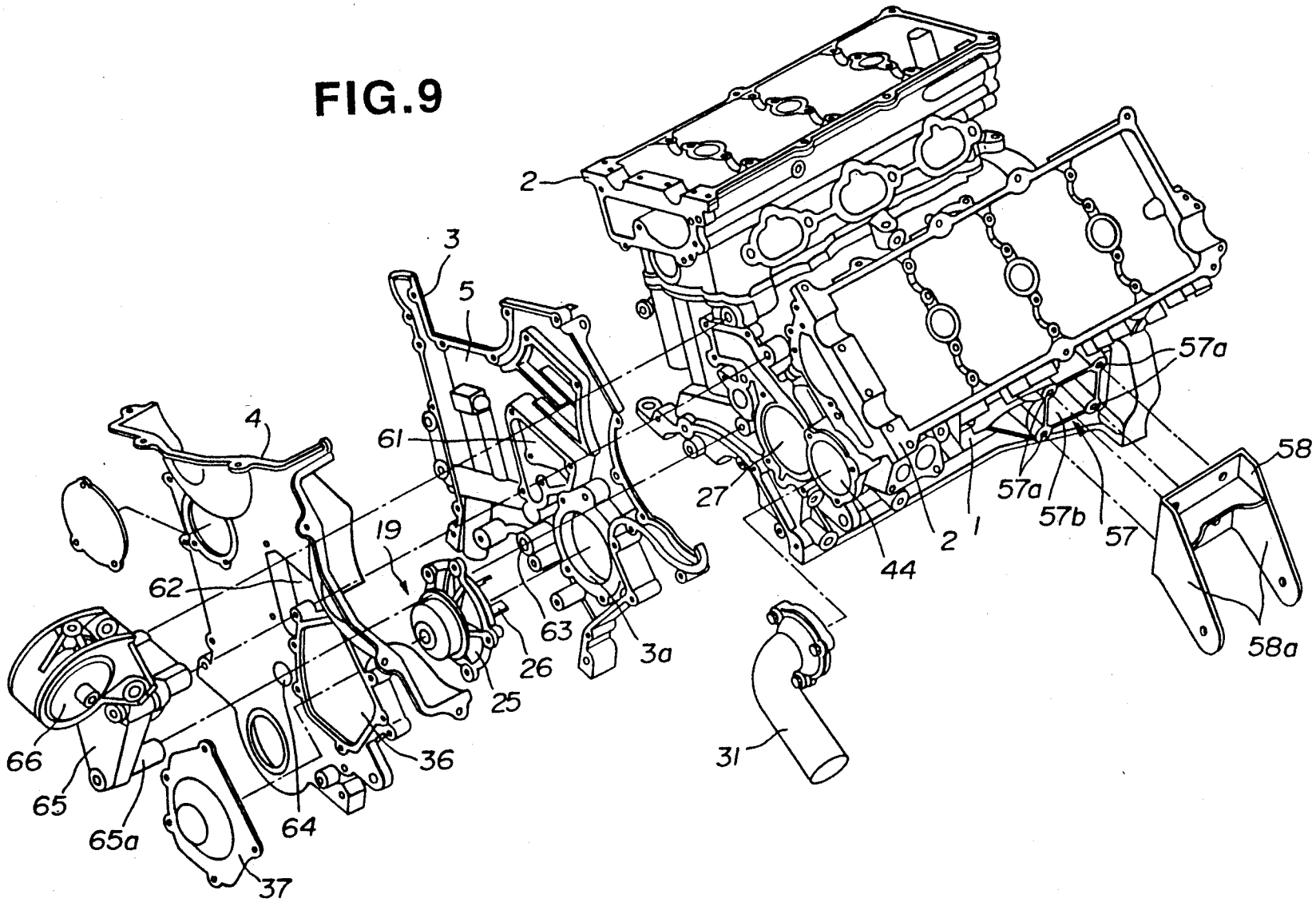
FIG. 9 is an exploded view of the engine of FIG. 8.

As shown in FIGS. 8 and 9, the cylinder block 1 is formed with engine mounting boss portions 57 at the rear left and right side portions. As seen from FIG. 9, each boss portion 57 is substantially rectangular in shape and consists of four cylindrical bosses 57*a* formed with threaded holes and vertical and horizontal ribs 57*b* interconnecting the bosses 57*a*. An engine mounting bracket 58 of a U-like or channel-like shape and having parallel arms 58*a* is bolted to each boss portion 57. The brackets 58, as shown in FIG. 8, are connected by way of engine mounting insulators 59 consisting mainly of cylindrical rubber members to the engine mounting boss portions 57, respectively.

The cylinder block 1 further has at a front end central portion surrounded by the timing chain 7 an engine mounting boss portion 60 consisting of three cylindrical bosses 60*a*. More specifically, the engine mounting boss portion 60 is arranged inside of its front end portion corresponding to an area bounded the timing chain 7 and adjacent to the center of gravity of the engine. The three cylindrical bosses 60*a* are arranged in such a manner that two are located in a higher place and equidistant from a vertical axis about which the front end of the cylinder block 1 is symmetrical and the remaining one is located in a lower place. The higher two bosses 60*a* are exposed to the outside through the chain case rear member 3 and the chain case front member 4, i.e., through nearly triangular openings 61 and 62 formed in the chain case rear member 3 and the chain case front member 4, respectively. Further, the lower one boss 60*a* is also exposed to the outside through the chain case front member 4, i.e., through circular openings 63 and 64 formed in the chain case rear member 3 and the chain case front member 4, respectively. The peripheral portions around the openings 61 to 64 are sealed against the chain case rear member 3 and the chain case front member 4 by means of, for example, liquid gasket.

As shown in FIG. 9, an engine mounting bracket 65 having three leg portions 65*a* corresponding to the respective bosses 60*a* is secured with bolts (not shown) to the engine mounting boss portion 60. The engine mounting bracket 65 is secured to a vehicle body (not shown) by way of a cylindrical engine mounting insulator 66. The amount of protrusion of each boss 60*a* is relatively small so that the leg portions 65*a* of the bracket 65 are inserted into the openings 60 to 63 for connection with the bosses 60*a*.

From the foregoing, it will be understood that the water pump 19 is driven by the timing chain 7 at the same time when the timing chain 7 drives the valve operating mechanism. By this, the water pump 19 is no more necessitated to be arranged in the place forward of the chain chamber 5, i.e., it becomes possible to reduce the amount of projection of the water pump 19 in the forward direction of the engine for thereby reducing the lengthwise size of the engine.

It will be further understood that the water pump sprocket 21 is adapted to receive a force from the timing chain 7 at a place axially coincident with the bearing 32, thus making it possible to reduce the axially offset load on the bearing 32 and improve the durability thereof.

It will be further understood that the angle of contact of the timing chain 7 with the water pump sprocket 21 can be smaller as compared with the case where a V-belt drive is employed, thus making it possible for the bearing 32 to effect an improved durability.

It will be further understood that the water pump sprocket 21 can serve as an idle sprocket, thus eliminating the necessity of an additional idle sprocket and making it possible to reduce in number the constituent parts. Such elimination of an idle sprocket increases the freedom of layout, thus making it possible to arrange the water pump 19 at a place adjacent to the front end central portion of the engine for thereby making the engine small-sized.

It will be further understood that the thermostat housing 45 can be arranged at the front end of the engine by efficiently utilizing the space obtained between the exhaust valve operating camshaft sprocket 14 at the outer side portion of the bank of the cylinder head 1 and the water pump 19 since the timing chain 7 can be disposed relatively inside at the front end portion of the engine. By this, the thermostat housing 45 can be disposed at one side of the engine without substantially protruding therefrom, thus making it possible to attain a small-sized engine. In this connection, as seen from FIG. 4, the amount of protrusion of an engine accessory such as the alternator 48 can also be small.

It will be further understood that the thermostat housing 45 is arranged adjacent to the water pump 19 and furthermore formed integrally with the cylinder head 2, the coolant passage extending between the thermostat housing 45 and the water pump 19 can be formed as an internal passage, i.e., a passage inside of the engine as described above, thus making it possible to simplify the outside piping. In case where the water pump 19 is disposed within the chain chamber 5 according to the present invention, such an internal passage can solve a problem of a seal which is otherwise caused when an outside pipe for connection to the water pump 19 is employed.

It will be further understood that since the thermostat housing 45 is formed at the front end of the engine and is directed forward of the engine, a good maintainability can be attained in the case of replacement, checking, etc. of the thermostat valve 30.

It will be further understood that the present invention makes it possible to support the the engine at the front end central portion thereof, i.e., at a place adjacent the center of gravity of the engine by means of the engine mounting bracket 65. By this, in case of installing a transversely mounted engine in, for example, a front engine front drive vehicle, it becomes possible to support the engine most efficiently at three points including two points at the rear side portions of the engine and one point at the front end portion of same, which is particularly advantageous from the engine vibration preventing point of view. This enables the engine mounting bracket 65 to be small-sized considerably.

What is claimed is:

1. A V-type internal combustion engine comprising:

a cylinder block having left and right banks;

two cylinder heads installed on the respective banks of said cylinder block;

two camshafts installed on said cylinder heads, respectively;

two camshaft sprockets located at front ends of said cylinder heads and installed on said respective camshafts for rotation therewith;

a crankshaft installed on said cylinder block;

a crankshaft sprocket located at a front end of said cylinder block and installed on said crankshaft for rotation therewith;

a timing chain placed around and engaged with said camshaft sprockets and said crankshaft sprocket for drivingly connecting said crankshaft to said camshafts; and a water pump installed on the front end of said cylinder block and having a water pump sprocket;

said water pump sprocket being disposed between one of said camshaft sprockets and said crankshaft sprocket and outside of an area bounded by said timing chain and engaged with said timing chain.

2. A V-type internal combustion engine according to claim 1, wherein said camshaft sprockets, said crankshaft sprocket and said water pump sprocket are arranged so as to lie on a common plane extending across said crankshaft and said camshaft at right angles.

3. A V-type internal combustion engine according to claim 2, wherein said water pump further comprises a pump housing installed on the front end of said cylinder block and having a hollow cylindrical portion, a pump shaft, first bearing means for supporting said pump shaft on an inner periphery of said cylindrical portion of said pump housing, and second bearing means for supporting said pump sprocket on an outer periphery of said cylindrical portion of said pump housing, said first and second bearing means being concentric and coincident with respect to an axial direction of said pump shaft.

4. A V-type internal combustion engine according to claim 3, wherein said first bearing means comprises a journal bearing formed in the inner periphery of said pump housing, said pump shaft having a journal portion supported on said journal bearing, said second bearing comprising a ball bearing.

5. A V-type internal combustion engine according to claim 4, further comprising a chain case rear member secured to the front ends of said cylinder block and said cylinder heads, and a chain case front member secured to a front end of said chain case rear member to form therebetween a chain chamber in which said timing chain is received.

6. A V-type internal combustion engine according to claim 1, further comprising second camshafts installed on said cylinder heads at locations nearer to outer sides of said banks than said first mentioned camshafts, drive means for drivingly connecting said first mentioned camshafts and said second camshafts, respectively, a thermostat housing formed integrally with a front end portion of one of said cylinder heads which is bounded by said water pump, one of said second camshafts and said timing chain.

7. A V-type internal combustion engine according to claim 6, wherein said drive means comprises second camshaft sprockets respectively installed on said first mentioned camshafts, third camshaft sprockets respectively installed on said second camshafts, and timing chains placed around and engaged with said second camshaft sprockets and said third camshaft sprockets, respectively.

8. A V-type internal combustion engine according to claim 7, wherein said second camshafts sprockets are located more forward of the engine than said first mentioned camshafts sprockets and adjacently thereto.

9. A V-type internal combustion engine according to claim 8, wherein said cylinder block and said one cylinder head are formed with an internal passage for providing communication between said thermostat housing and said water pump.

10. A V-type internal combustion engine according to claim 1, wherein said cylinder block comprises an engine mounting boss portion at a front end central portion surrounded by said timing chain.

11. A V-type internal combustion engine according to claim 10, wherein said cylinder block further comprises at rear side portions thereof two engine mounting boss portions for three-point support of the engine.

12. A V-type internal combustion engine comprising:

a cylinder block having left and right banks;

two cylinder heads installed on said banks of said cylinder block, respectively;

a pair of first camshafts installed on said cylinder heads, respectively;

a pair of first camshaft sprockets located at front ends of said cylinder heads and installed on said respective first camshafts for rotation therewith;

a pair of second camshaft sprockets installed on said respective first camshafts for rotation therewith and located adjacently forward of said first camshaft sprockets;

a pair of second camshafts installed on said respective cylinder heads and located nearer to outer sides of said banks than said first camshafts;

a pair of third camshaft sprockets installed on said respective second camshafts for rotation therewith;

a crankshaft installed on said cylinder block;

a crankshaft sprocket installed on said crankshaft for rotation therewith;

a first timing chain placed around and engaged with said first camshaft sprockets and said crankshaft sprocket for drivingly connecting said crankshaft sprocket to said first camshaft sprockets;

a pair of second timing chains placed around and engaged with said second and third camshaft sprockets for drivingly connecting said first camshafts to said second camshafts, respectively; and a water pump installed on a front end of said cylinder block and having a water pump sprocket;

said water pump sprocket being disposed between one of said first camshaft sprockets and said crankshaft sprocket and outside of an area bounded by said first timing chain and engaged with said first timing chain.

13. A V-type internal combustion engine according to claim 12, wherein said first camshafts are intake valve operating camshafts and said second camshafts are exhaust valve operating camshafts.

14. A V-type internal combustion engine according to claim 13, further comprising a thermostat housing formed integrally with a front end portion of one of said cylinder heads which is bounded by said water pump, one of said second camshafts and said timing chain.

15. A V-type internal combustion engine according to claim 14, wherein said cylinder block comprises an engine mounting boss portion at a front end portion surrounded by said timing chain and adjacent to a center of gravity of the engine.

16. A V-type internal combustion engine comprising:

a cylinder block having left and right banks;

two cylinder heads installed on said banks of said cylinder block, respectively;

a pair of intake valve operating camshafts installed on said cylinder heads, respectively;

a pair of first intake valve operating camshaft sprockets located at front ends of said cylinder heads and installed on said respective intake valve operating camshafts for rotation therewith;

a pair of second intake valve operating camshaft sprockets installed on said respective intake valve operating camshafts for rotation therewith and located adjacently forward of said first intake valve operating camshaft sprockets;

a pair of exhaust valve operating camshafts installed on said respective cylinder heads and located nearer to outer sides of said banks than said intake valve operating camshafts;

a pair of exhaust valve operating camshaft sprockets installed on said respective exhaust valve operating camshafts for rotation therewith;

a crankshaft installed on said cylinder block;

a crankshaft sprocket installed on said crankshaft for rotation therewith;

a first timing chain placed around and engaged with said first intake valve operating camshaft sprockets and said crankshaft sprocket for drivingly connecting said crankshaft to said intake valve operating camshafts;

a pair of second timing chains placed around and engaged with said second intake valve operating camshaft sprockets and said exhaust valve operating camshaft sprockets for drivingly connecting said intake valve operating camshafts to said exhaust valve operating camshafts, respectively;

a water pump installed on a front end of said cylinder block and having a water pump sprocket;

said water pump sprocket being disposed between one of said first intake valve operating camshaft sprockets and said crankshaft sprocket and outside of an area bounded by said first timing chain and engaged with said timing chain; and a thermostat housing formed integrally with a front end portion of one of said cylinder heads which is bounded by said water pump, one of said exhaust valve operating camshafts and said timing chain; and an engine mounting boss portion formed integrally with said cylinder block at a front end central portion surrounded by said timing chain.

* * * * *